US010010227B2

(12) United States Patent
Lawhon

(10) Patent No.: US 10,010,227 B2
(45) Date of Patent: Jul. 3, 2018

(54) SPRING ACTIVATED DEVICE FOR THE SELF RISING OF A TOILET SEAT

(71) Applicant: Doyle Lawhon, Dallas, TX (US)

(72) Inventor: Doyle Lawhon, Dallas, TX (US)

( * ) Notice: Subject to any disclaimer, the term of this patent is extended or adjusted under 35 U.S.C. 154(b) by 0 days.

(21) Appl. No.: 15/277,284

(22) Filed: Sep. 27, 2016

(65) Prior Publication Data

US 2018/0084958 A1 Mar. 29, 2018

(51) Int. Cl.
*A47K 13/10* (2006.01)
*A47K 13/12* (2006.01)

(52) U.S. Cl.
CPC ..... *A47K 13/10* (2013.01); *A47K 13/12* (2013.01)

(58) Field of Classification Search
CPC ..... A47K 13/10
USPC ..... 4/237–241
See application file for complete search history.

(56) References Cited

U.S. PATENT DOCUMENTS 3,417,411 A 12/1968 Greenwood
4,965,890 A 10/1990 Fischer
2013/0174336 A1 7/2013 Erman

OTHER PUBLICATIONS

International Search Report of the International Searching Authority mailed by ISA/USA, U.S. Patent and Trademark Office dated Feb. 17, 2017 for International Patent Application No. PCT/US2016/064583.

*Primary Examiner* — Lori Baker
(74) *Attorney, Agent, or Firm* — Law Office of Jeff Williams; J. Oliver Williams

(57) ABSTRACT

A device for the self rising of a toilet seat includes a toilet seat, at least one torsion spring with a first and second end, a bar passing through the torsion spring, and a spacer located on the bar. The toilet seat has a base portion and a seat portion. The torsion spring second end is in communication with the seat portion. The first and second ends are biased relative to one another such that they operate between a resting state and a loaded state. The resting state locates the seat portion in an elevated raised position.

7 Claims, 2 Drawing Sheets

SPRING ACTIVATED DEVICE FOR THE SELF RISING OF A TOILET SEAT

BACKGROUND

1. Field of the Invention

The present application relates generally to a toilet seat, and in particular to a device for a self rising toilet seat.

2. Description of Related Art

Toilet seats, particularly in public restrooms, are often soiled by individuals who urinate while standing up. This means that the next person to sit down on the toilet seat has to clean the seat or find another toilet. Paper toilet covers do not mitigate this problem because the paper simply wicks the urine up to the user's skin. This inconvenience can be avoided by raising the toilet seat to an upright position before use.

It is desired that a system be developed to keep the toilet seat raised in an elevated position until otherwise needed. The system designed automatically returns the toilet seat to the elevated position when the seat is not in use. In this way the toilet seat is not soiled by individuals who urinate while standing up. Although great strides have been made, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
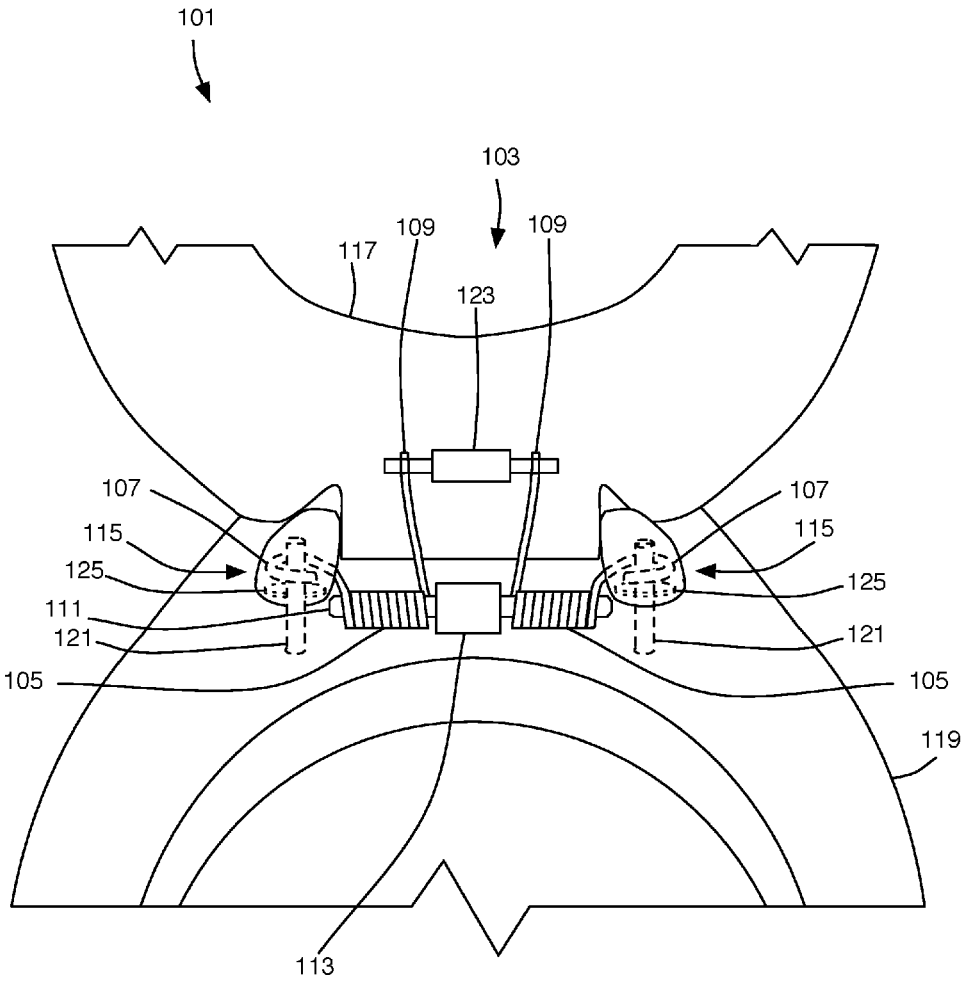
FIG. 1 is an illustration of a device for the self rising of a toilet seat according to a preferred embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The system and method in accordance with the present application overcomes one or more of the above-discussed problems commonly associated with conventional toilet seats. The spring assembly for the self rising of a toilet seat includes at least one torsion spring with a first and second end, a bar passing through the torsion spring, a spacer located on the bar and a roller coupled to the torsion spring second end. The first end of the torsion spring is coupled to the non-rotating portion of the toilet seat. The roller is placed in contact with the rotating portion of the toilet seat in such a manner that the toilet seat is in the elevated raised position when not in use. The spacer and roller prevent the spring from marring the toilet and toilet seat. These and other unique features of the system and method are discussed below and illustrated in the accompanying drawings.

The system and method will be understood, both as to its structure and operation, from the accompanying drawings, taken in conjunction with the accompanying description. Several embodiments of the assembly are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

Referring now to the drawings wherein like reference characters identify corresponding or similar elements in form and function throughout the several views. FIG. 1 is an illustration of a device for the self rising of a toilet seat according to a preferred embodiment of the present application. System 101 is comprised of a toilet seat 103, at least one torsion spring 105 with a first end 107 and second end 109, a bar 111 passing through the at least one torsion spring 105, and a spacer 113 located on bar 111. Toilet seat 103 includes a base portion 115 and a seat portion 117. Base portion 115 is of toilet seat 103 that couples to a toilet bowl 119. Base portion 115 may be a threaded portion 121 of a toilet seat 103 or any portion of toilet seat 103 used to mate with toilet bowl 119. An example of threaded portion 121 is a bolt, which may be made of a variety of materials including steel, brass, and nylon. Base portion 115 does not rotate when coupled to the toilet bowl 119. Seat portion 117 is the part of toilet seat 103 that rotates between an elevated raised position when not in use and a horizontal lowered position for use.

Second end 109 is in communication with the seat portion 117. System 101 may include a roller 123, coupled to second end 109 and is in communication with the seat portion 117. Roller 123 is configured to separate second end 109 from the seat portion 117. Roller 123 is composed of material designed to prevent marring of seat portion 117. First end 107 is coupled to base portion 115. First end 107 and second end 109 are biased relative to one another such that they operate between a resting state and a loaded state. The resting state locates seat portion 117 in the elevated raised position. The loaded state locates seat portion 117 in the horizontal lowered position for use.

Spacer 113 located on bar 111 has an outside diameter larger than the diameter of at least one torsion spring 105. Spacer 113 is made of or coated with a material that prevents marring of toilet bowl 119 by at least one torsion spring 105.

System 101 may include a washer 125 located on the base portion of toilet seat 103. Washer 125 located on threaded portion 121 between first end 107 and toilet bowl 119 and configured to prevent marring of toilet bowl 119.

System 101 may be configured such that the at least one torsion spring 105 is external to base portion 115. System 101 may also be configured such that the at least one torsion spring 105 is at least partially internal to base portion.

A portion of the elements of System 101 that comprise a spring assembly are at least one torsion spring 105 with a first end 107 and a second end 109, a bar 111 passing through at least one torsion spring 105, a spacer 113 located on bar 111, and a roller 123 coupled to second end 109.

Figure 2:
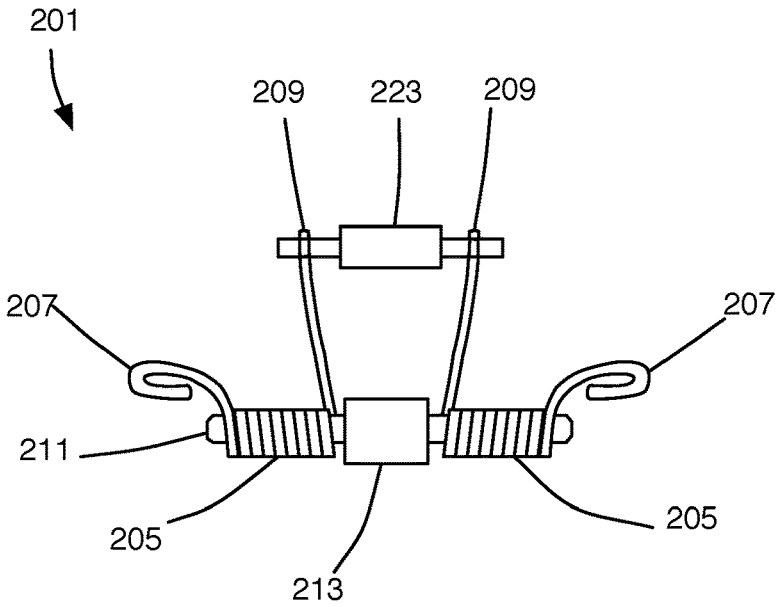
FIG. 2 is an illustration an alternate embodiment of the device of FIG. 1, a spring assembly.
Figure 3:
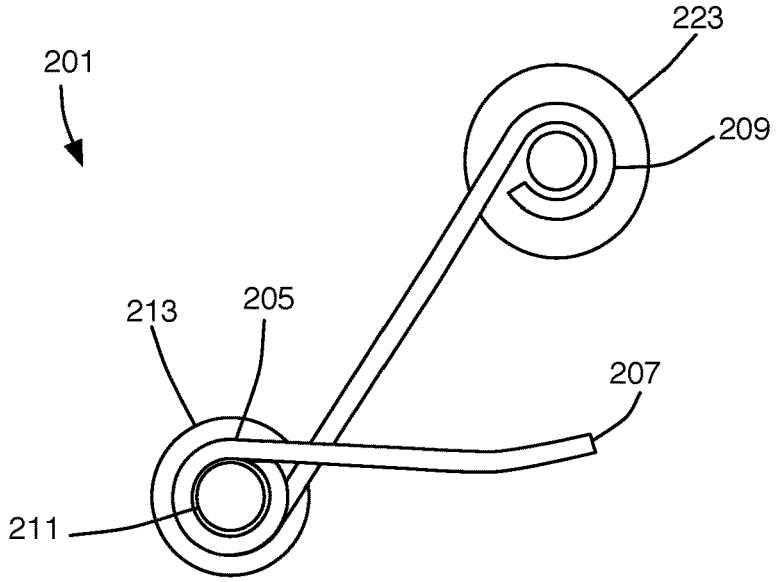
FIG. 3 is an illustration of the side view of the assembly of FIG. 2.

Referring now to FIGS. 2 and 3, an illustration of System 201, a spring assembly of a preferred embodiment. System 201 is similar in form and function to the spring assembly of System 101. The toilet seat and toilet bowl of System 101 have been removed. System 201 is comprised of at least one torsion spring 205 with a first end 207 and a second end 209, a bar 211 passing through at least one torsion spring 205, a spacer 213 located on bar 211, and a roller 223 coupled to second end 209. The outside diameter of spacer 213 is larger than the outside diameter of at least one torsion spring 205. First end 207 and second end 209 operate between a resting state and a loaded state.

The spring assembly 201 may be a standalone unit and as such may be installed and removed from the toilet seat as a standalone unit.

Coupling the spring assembly for self raising a toilet seat includes coupling the first end of at least one torsion spring to the threaded member of the base portion. Coupling the first end to the threaded member may be accomplished using various attachment methods including looping the first end around the threaded member and capturing the first end between the base member and the toilet bowl. The second end of at least one torsion spring is placed in communication with the seat portion. Locating a roller in communication with the second end separates the second end from the seat portion. The first end and the second end operate between a resting state and a loaded state.

Operation of the spring assembly in communication with the toilet seat is performed by a user lowering the seat portion of the toilet seat to allow the user to sit on the seat portion. When the user is through using the seat portion, the spring assembly is configured to automatically raise the seat portion.

Removal of the spring assembly from the toilet seat may be accomplished by uncoupling the torsion spring first end from the threaded member and removing the torsion spring second end from communication with the seat portion.

Operation of a preferred embodiment is accomplished with at least one torsion spring external to the base portion. Other embodiments are contemplated by locating at least one torsion spring at least partially within the base portion.

The current application has many advantages over the prior art including at least the following: (1) The system keeps the toilet seat raised in an upright position until otherwise needed; (2) The system designed automatically returns the toilet seat to the upright position when the seat is not in use; and (3) The toilet seat is not soiled by individuals who urinate while standing up. The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A device for the self rising of a toilet seat having a base portion with a pair of fasteners to couple the toilet seat to a toilet bowl, the toilet seat also including a seat portion, comprising:

a pair of torsion springs with a first end and a second end, the first ends in communication with the pair of fasteners of the base portion, the second ends adjacent to a lower surface of the seat portion, the pair of torsion springs being exposed between the pair of fasteners, the first ends housed within the base portion;

a bar passing through the pair of torsion springs; and a spacer located on the bar between the pair of torsion springs and having an outside diameter larger than the pair of torsion springs, the spacer configured to contact a surface of the toilet bowl to prevent the toilet bowl from contacting the pair of torsion springs;

wherein the first ends and the second ends are biased relative to one another such that they operate between a resting state and a loaded state, the resting state locates the seat portion in an elevated raised position.

2. The device of claim 1, further comprising:

a roller coupled to the second end and in communication with the seat portion, the roller is configured to separate the second end from the seat portion.

3. The device of claim 2, wherein the roller is composed of a material designed to prevent marring of the seat portion.

4. The device of claim 1, further comprising:

a washer located on a base portion of the toilet seat, the base portion including a threaded portion for securing the toilet seat to the toilet bowl.

5. The device of claim 1, wherein the loaded state includes the seat portion in a horizontal position for use.

6. The device of claim 1, wherein the pair of torsion springs are external to the base portion.

7. The device of claim 1, wherein the pair of torsion springs are at least partially internal to the base portion.

* * * * *